US010143877B2

(12) United States Patent
DiMenichi

(10) Patent No.: US 10,143,877 B2
(45) Date of Patent: Dec. 4, 2018

(54) STEP LOCK CONTROL

(71) Applicant: Tony A. DiMenichi, Crestview, FL (US)

(72) Inventor: Tony A. DiMenichi, Crestview, FL (US)

( * ) Notice: Subject to any disclaimer, the term of this patent is extended or adjusted under 35 U.S.C. 154(b) by 25 days.

(21) Appl. No.: 15/263,359

(22) Filed: Sep. 12, 2016

(65) Prior Publication Data

US 2017/0100654 A1 Apr. 13, 2017

Related U.S. Application Data

(60) Provisional application No. 62/216,731, filed on Sep. 10, 2015.

(51) Int. Cl.

| | |
|---|---|
| ***A63B 22/06*** | (2006.01) |
| ***A63B 21/008*** | (2006.01) |
| ***A63B 22/04*** | (2006.01) |
| ***A63B 21/068*** | (2006.01) |
| ***A63B 23/035*** | (2006.01) |
| ***A63B 21/00*** | (2006.01) |
| ***A63B 23/04*** | (2006.01) |
| *A63B 21/02* | (2006.01) |

(52) U.S. Cl.

CPC .... *A63B 21/0083* (2013.01); *A63B 21/00069* (2013.01); *A63B 21/068* (2013.01); *A63B 21/158* (2013.01); *A63B 21/4034* (2015.10); *A63B 22/04* (2013.01); *A63B 23/03533* (2013.01); *A63B 23/03575* (2013.01); *A63B 23/0429* (2013.01); *A63B 21/023* (2013.01); *A63B 21/4035* (2015.10); *A63B 21/4045* (2015.10); *A63B 2225/093* (2013.01)

(58) Field of Classification Search

CPC ..... A63B 21/0083; A63B 23/0405; A63B 23/0429; A63B 23/0458; A63B 22/0056; A63B 22/0048

See application file for complete search history.

(56) References Cited

U.S. PATENT DOCUMENTS

| | | | | |
|---|---|---|---|---|
| 4,685,669 | A | 8/1987 | DeCloux | |
| 4,708,338 | A | 11/1987 | Potts | |
| 5,114,389 | A | 5/1992 | Brentham | |
| 7,497,811 | B2 | 3/2009 | Kumar | |
| 7,553,260 | B2 * | 6/2009 | Piaget ..... | A63B 22/0056 482/51 |
| 7,833,134 | B2 | 11/2010 | Gordon | |

* cited by examiner

*Primary Examiner* — Loan H Thanh
*Assistant Examiner* — Rae Fischer
(74) *Attorney, Agent, or Firm* — Kattina V. Barsik, Esq.

(57) ABSTRACT

The present invention provides a bodyweight-bearing process and device for stair-stepping and climbing exercise, resolving an unmet need in the industry of climbing and stair-based exercise machines. It surpasses all previously patented and commercially available exercise and physical therapy equipment which aim to replicate the act of climbing, by achieving a more complete, correct and natural movement for the user. As indicated by the expanding body of knowledge and evolving recommendations of the exercise science community and health and fitness industries, full-body conditioning and bodyweight-bearing movements, as accomplished by the present invention, are the most effective exercises for weight-loss, strength-training and overall maintenance of health.

6 Claims, 5 Drawing Sheets

STEP LOCK CONTROL

CROSS REFERENCE TO RELATED APPLICATIONS

The present application claims priority under 35 U.S.C. 0119(e) from U.S. Provisional Application Ser. No. 62/216,731, filed Sep. 10, 2015. The entire contents of this application are incorporated by reference herein.

FIELD OF THE INVENTION

The present invention pertains to the fields of exercise and other devices and can serve as a stand-alone machine or an attachment to or enhancement to existing apparatus.

BACKGROUND OF THE INVENTION

The present invention chiefly resolves the unmet need in the industry of climbing and stair-based exercise machines. While many commercially available and previously developed products claim to replicate the act of climbing, none achieves the total function as described herein. Further, the present invention more so suits the full-body conditioning and bodyweight workout trends which are currently touted as the most effective and hence very popular. Many tools and machines in the art, as well as commercially available products, rely heavily on horizontal movements, even in weight-bearing activities, thereby decreasing the amount of energy required to accomplish these movements and providing a disservice to the user. As an illustrative example of this substantial but common shortcoming in commercial exercise science, a human being of average height and weight can walk a mile on a horizontal plain in about twenty (20) minutes. Modifying the slope of that surface to the vertical plain changes the undertaking from a walk to a climb. At the same rate of advancement, the person would climb the equivalent of a 29,000 foot mountain (such as Mt. Everest) in about 2 hours! There is a notable absence in the art of truly vertical, weight-bearing machines. The present invention addresses this and the other unmet needs mentioned above and avoids the shortcomings of the current attempts at solutions.

SUMMARY OF THE INVENTION

The present invention provides a novel process and apparatus for climbing and stair stepping exercise, and may be utilized for various other functions which require, or are enhanced by, step lock control. By enabling the user to move his/her own body mass vertically as opposed to horizontally (as with walking or running), the present invention it compels a much higher energy expenditure to move the same amount of mass, the same distance, in the same amount of time. Further, it provides a more appropriate and life-like training tool for certain activities, such as rock climbing, scaling and other outdoor activities, which pose a significant element of danger for those who attempt them while not fully prepared. As noted above, the present invention greatly improves upon previous and existing technology, as it enables efficient and fully weight-bearing exercise, high-intensity strength training and overall conditioning.

BRIEF DESCRIPTION OF THE FIGURES

Unless otherwise stated, all dimensions are in inches and drawings are not to scale.

DETAILED DESCRIPTION OF INVENTION AND PREFERRED EMBODIMENTS

Figure 1:
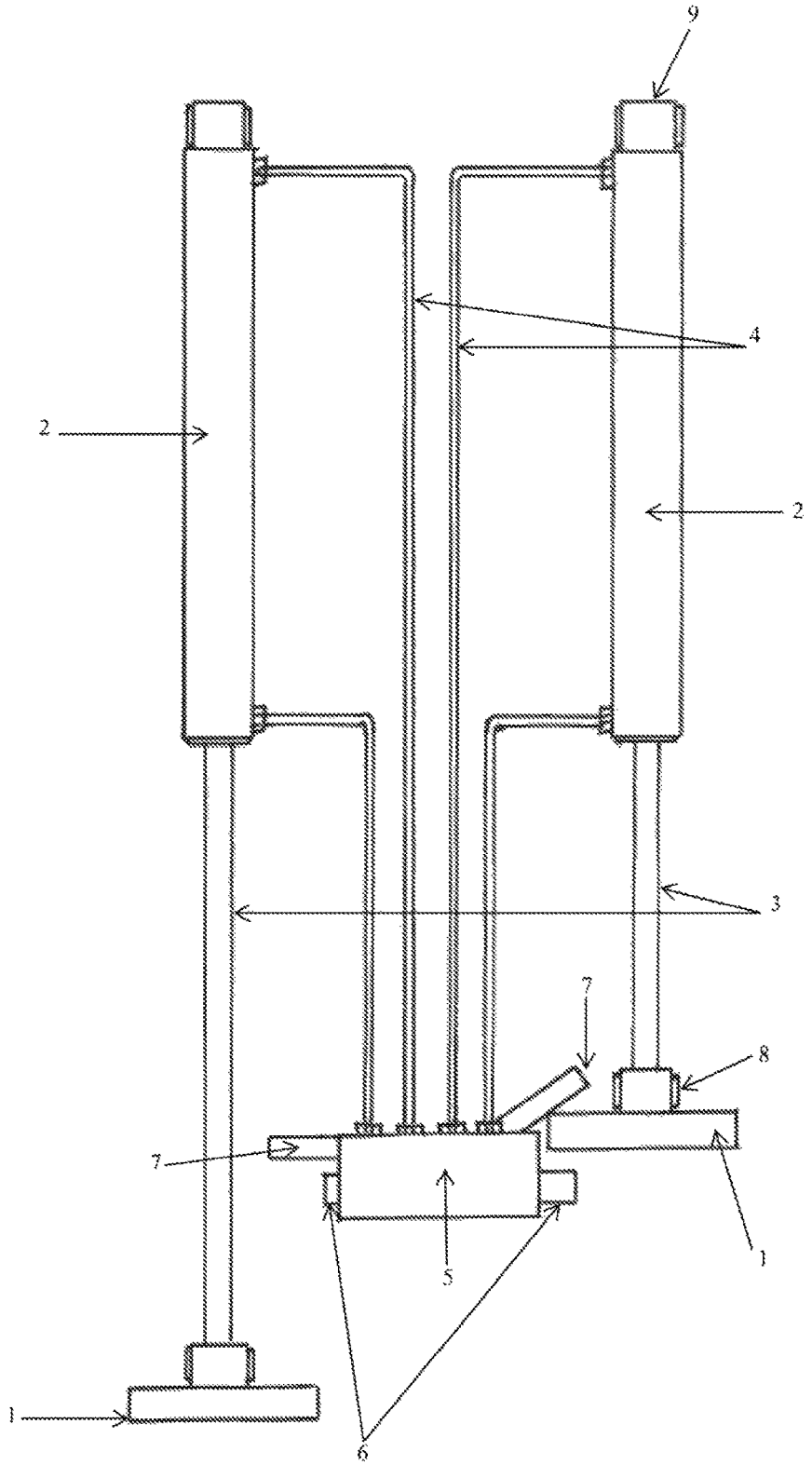
FIG. 1 provides a view of the present invention, in its stationary form, with the hydraulic catch and release in its installed view.
Figure 2:
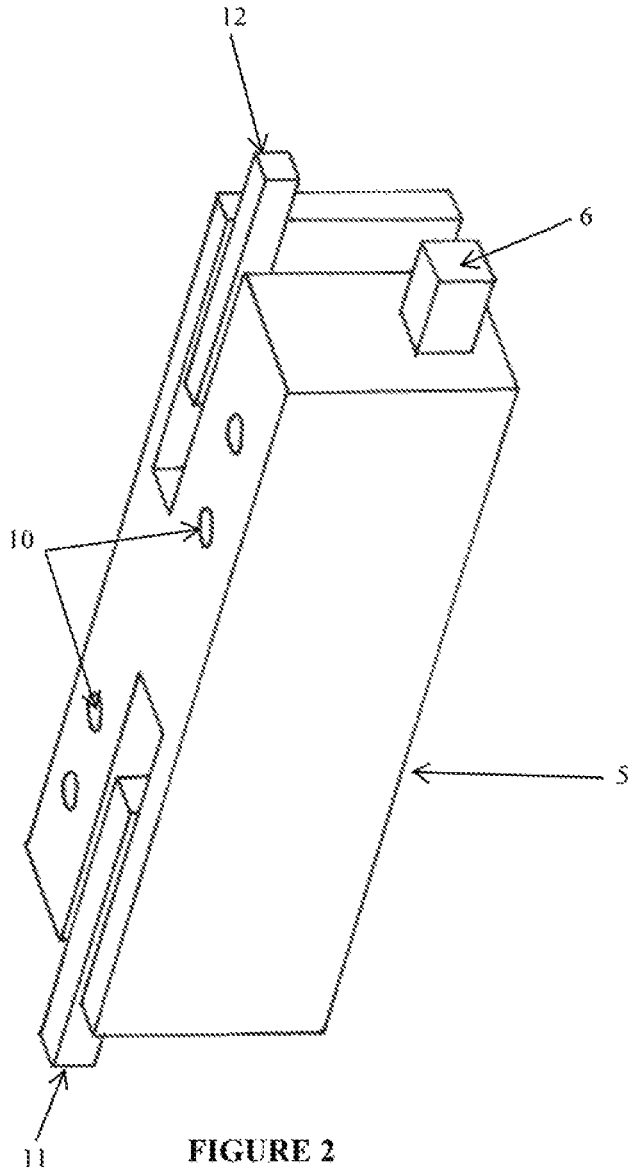
FIG. 2 is the hydraulic catch and release valve in its assembled view.
Figure 3:
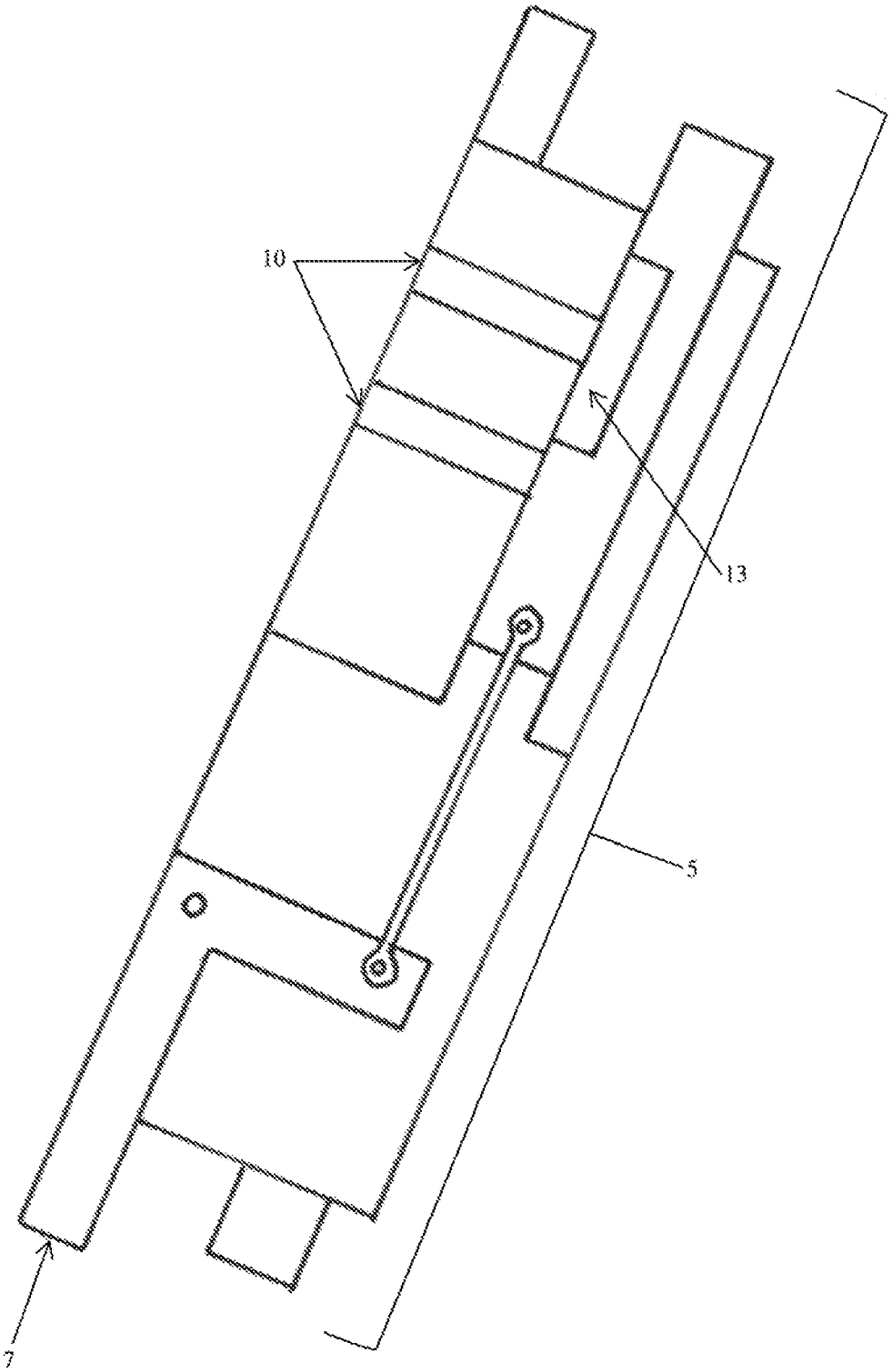
FIG. 3 is a representation of the internal view of the present hydraulic catch and release invention, with an emphasis on the hydraulic bypass ports 10 and fluid bypass 13 individually labeled components.

The present invention is a novel apparatus to achieve what is generally accepted in the world of exercise science, endurance building, and strength training. In terms of energy and power required, and subsequently the value added to the particular exercise or activity, vertical movements of one's body mass eclipse the results generated by those attempted in the horizontal plane. The present invention—incorporated into a step-type exercise machine, as an example—maximizes the time spent and energy expended by the user, as s/he will utilize a greater amount of energy to move the same mass, traversing the same distance, in the same amount of time, as compared to treadmills, elliptical machines, and other traditional forms of stationary exercise. The present invention has accomplished this goal and can be completely differentiated from earlier attempts to duplicate intense weight-bearing activities. To start with, the present invention allows the user to move 100% of his/her body mass in the vertical plane, because it eliminates all horizontal movement. As noted above in the example involving Mt. Everest, converting walking movements to a climbing exercise greatly increases the impact, without necessarily altering the time required to engage in the physical activity. Those who engage in outdoor climbing and other high-impact, high-risk physical activities must ensure their physical abilities before undertaking certain feats. Real-life, efficient training, with the benefits and convenience of an indoor, stationary apparatus, would greatly enhance their experience and better prepare them for the tasks to be faced "in the field."

The present invention, as detailed below, features an active tread, the one that the user is stepping upon at the then-current moment, which is locked and stationary while the user is actively stepping up. Importantly, this invention manages to eliminate all reactionary movement of the exercise apparatus. This is crucial as, with any apparatus with a reactionary movement, the user's feet and/or legs will be moving up and down or otherwise, instead of the more beneficial action of the user's body mass moving up. In the context of the current invention, all of the user's body weight will be moving vertically with each step or other movement. Thus, a 12" step taken on or with the present invention is a true 12" movement, raising, lowering, and supporting, of the user's body mass. Finally, and related to the previous example, the step lock control underlying the present invention fully removes momentum from the particular movement and maximizes acceleration, which is largely important in the movement of mass. When climbing a set of fixed stairs a person's body is in continuous motion and momentum helps keep the body in motion. With the step lock control of the present invention, each step is a new step which eliminates momentum and adds acceleration to each step.

The key element of the present invention is to have the device in the stopped or stationary condition when the user is in the act of stepping or climbing. The action being described herein is the up and down movement of each platform or tread 1. As further described below, the "stopping" of the device will allow the user to duplicate a climbing action exactly and in its entirety by lifting his or her entire body weight without any opposite movements or reactions from the device which is the primary point and intent of this device.

In a preferred embodiment, the present invention could feature handles or other hand holds or grips at the appropriate height for the user. These would be directly connected or otherwise coupled to and operate in sync with the foot-operated treads. This embodiment allows the present invention to work both the upper and lower extremities, and, to varying degrees, engages the user's core.

The "sensing" devices are used to control the individual releasing of the treads or platforms and may be accomplished by various means. The preferred means devised by applicant are mechanical and hydraulic methods. The controlling device of the present invention functions well via a hydraulic method of operation and comprises the following components.

The treads (or foot-steps or holds) are an integral piece of the present invention. Each of the two treads is connected to a hydraulic cylinder with a return system, either spring or equivalent which controls the up and down travel of each tread. Each of the hydraulic cylinders 2 is double-acting whereby there is fluid on both sides of the internal piston 3. There is a bypass line 4 on each side which connects one side of the outer piston sleeve with the other. The piston has a one way valve in the piston head which allows for an unobstructed one way travel in the return movement.

The bypass line 4 connects one side of the piston sleeve to the other and has an open/close hydraulic control valve 5. The bypass line will allow hydraulic fluid to freely pass from one side of the piston sleeve to the other when the control valve is opened and stop the fluid passage and "lock-in" the movement of the piston and tread when a control valve is closed.

Figure 5:
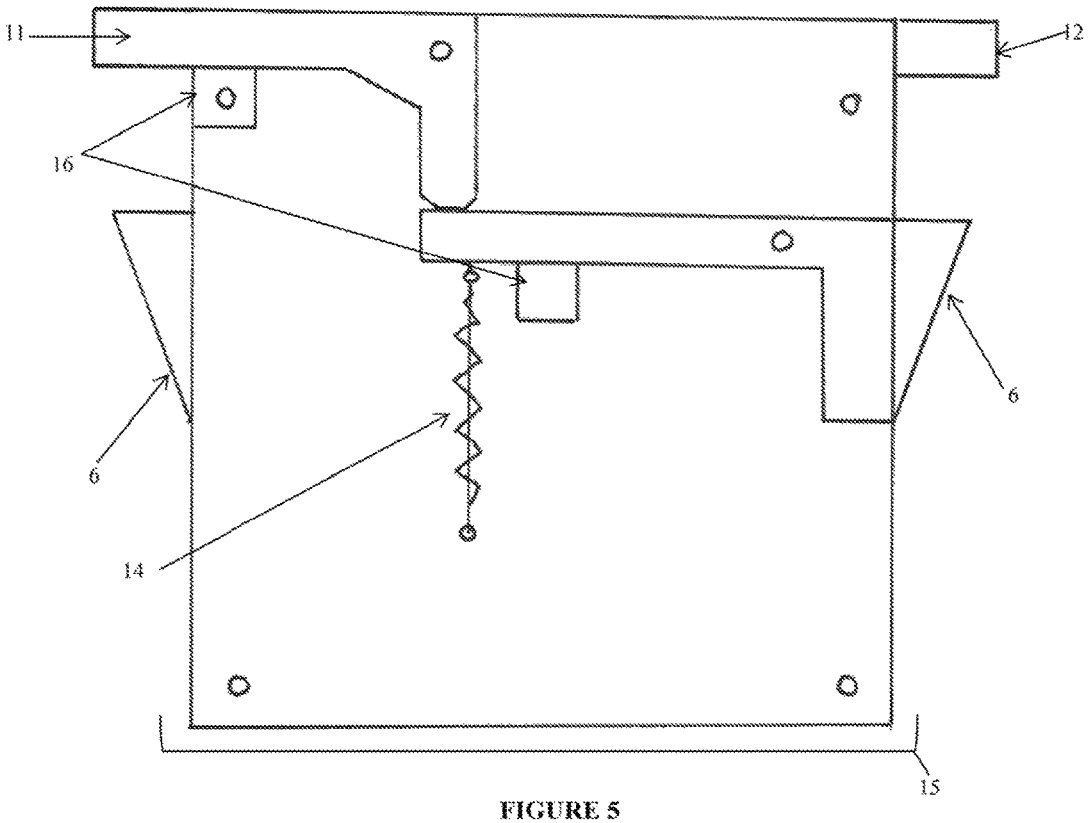
FIG. 5 provides an internal view of the mechanical version of the catch and release mechanism on an exemplary depiction of a mounting plate 15 with individually labeled parts.

There is a tread catch 6 operated by the movement of the treads. When the control valve is closed for either side, the corresponding tread cannot be depressed. When the control valve is opened, the hydraulic fluid will pass from one side of the piston sleeve to the other allowing the piston and tread to be depressed. Each tread controls the opposing side tread release 7; thus the right tread controls the left tread release and the left tread controls the right tread release, both at the uppermost position. As depicted in FIG. 5, each of the right tread release 11 and left tread release 12 is capable of upward movement only. Each of the tread catches 6 has a retractable face, which is spring loaded, allowing upward movement of the tread to fully pass the tread catch before releasing the opposing tread.

The movable pivot 8 serves as the pivot point between the tread and the lower rod of the hydraulic cylinder assembly, as represented in FIG. 1. It is differentiated from the stationary pivot 9, because it is designed to traverse the full movement of the tread. The hydraulic bypass ports 10 in the control valve, when open, facilitate the flow of hydraulic fluid throughout the cylinder. There are two one-way valves, which are located in the piston head and provide for a smooth and quick transition in the return movement.

The process by which the present invention operates includes the following steps. The one-way valve allows the cylinder that is in the returning action to continue the upwards movement even after the control valve is closed. The step-height is adjustable by raising the control valve height.

Starting Position: Both treads in the up-position, both tread releases 7 active, both sliding valves in released (open) position, both hydraulic cylinders are ready for downward movement.

First Action: User places weight on either tread and depresses to bottom automatically locking in the opposite tread in the upper position at the same time.

Second Action: User steps up on upper locked in tread and extends the leg and rises until the leg is fully extended. The opposite foot follows upwards in a natural direction allowing that tread to follow.

Figure 4:
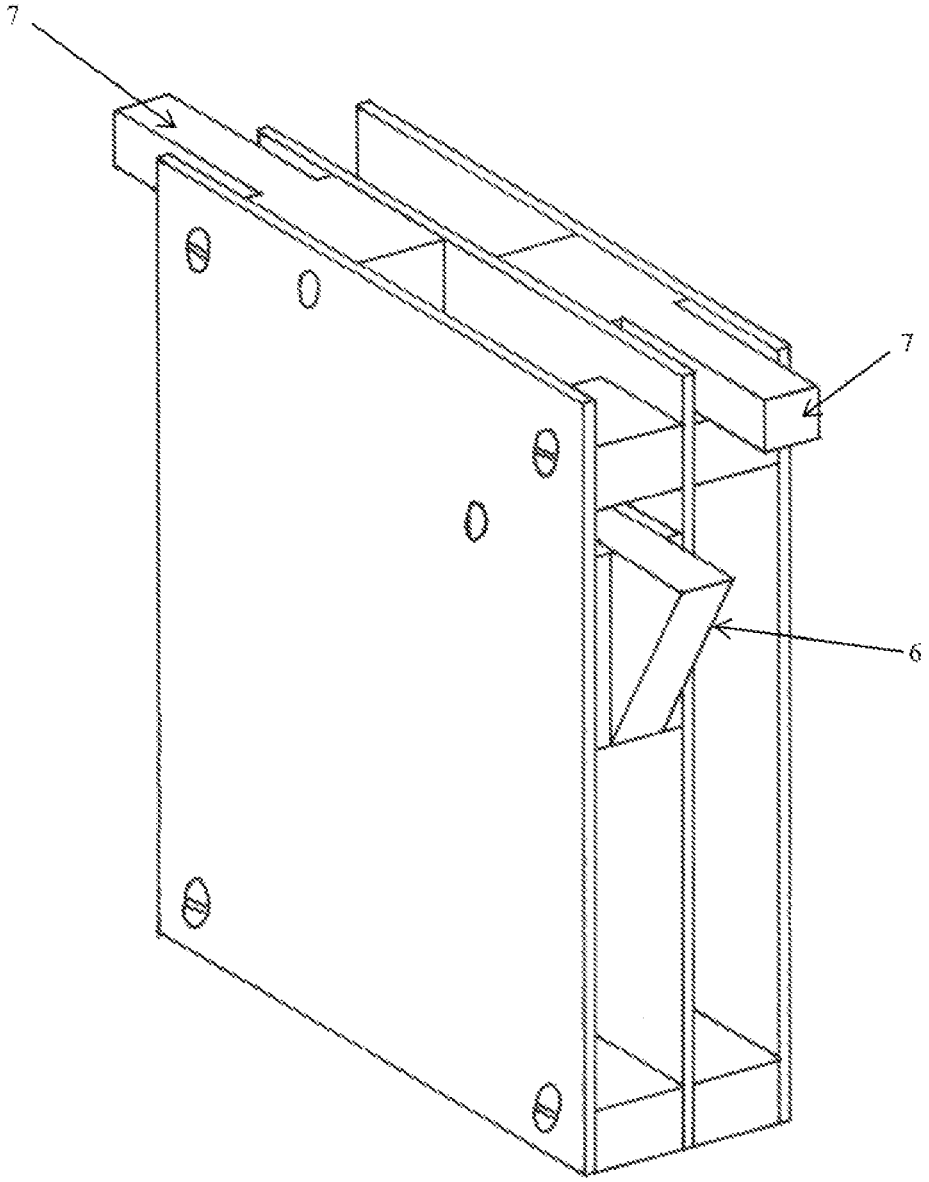
FIG. 4 demonstrates the mechanical version of the catch and release mechanism of the present invention, in its assembled form.

Third Action: The rising tread passes a catch and trips the opposite tread release arm which opens the control valve and allows the opposite tread to fall dampened by the hydraulic cylinder. As shown in FIG. 4, the face of the tread catch is retractable and is spring-loaded to allow upward movement of tread to fully pass the catch before releasing the opposite tread.

Fourth Action: The user again rises up on the uppermost (locked in) tread and the cycle repeats. The cycle repeats as long as the user continues to step up on the locked tread.

As noted herein, the present invention provides numerous benefits to the user and improvements over existing technology. Most importantly, the present invention results in increased caloric expenditure and efficiency of such expenditure. Current exercise science and the trends of consumers point to whole body, conditioning exercises and high-intensity workouts; the present invention facilitates maximum caloric burn for this type of movement and exercise apparatus, as the user is fully vertical and the climbing movement is entirely weight-bearing. The present invention is safer than traditional treadmills, as it is non-motorized and requires no electricity for use. Similarly, it is suitable for all ages of users and accommodates all degrees of ability and/or physical condition, including users who require low impact and/or low rep exercise, as it provides a high mass, low repetition movement. Further, it is cost-efficient and convenient, as it: is capable of use by one or more users at varying experience and fitness levels; capable of adjusting to the changing needs and fitness level of the individual user; fully adjustable; and finally, takes up a relatively small amount of space, compared to traditional, commercially available apparatus.

The present invention has utility for and retail marketability to individuals, as noted above, as well as on the wholesale market to health and fitness franchises and clubs. It will serve an unmet need in: hospitals, doctors' offices, and other clinical settings; hotels and motels and apartments and other small residential and living spaces; rehabilitation facilities; and physical therapy, military, organized and professional sports and fitness training programs.

The present invention is more fully described by way of the non-limiting embodiments, figures and examples of the forms and utilities of the invention herein. Modifications of these examples and illustrations will be apparent to those skilled in the art. As such, the foregoing examples and description of the prototype built by Applicant and preferred embodiments should be interpreted as illustrating, rather than as limiting, the present invention as defined herein. All variations and combinations of the features above are intended to be within the scope of this application.

What is claimed is:

1. An apparatus for duplicating climbing movement of a user, the apparatus comprising:

two treads, a first tread and a second tread, each of the first tread and the second tread configured to move vertically to-and-fro from a reference plane;

tread controls configured to the two treads, in that, a first tread control configured to the first tread, and a second tread control configured to the second tread, such that, the first tread control controls to-and-fro movement of the second tread, and the second tread control controls to-and-fro vertical movement of the first tread;

two hydraulic cylinders with internal pistons, each of the two hydraulic cylinders configured to the respective treads to move vertically to-and-fro, the respective treads, from the reference plane;

at least one control valve configured along the reference plain, the at least one control valve, at a closed position, restricts two of the hydraulic cylinders with internal pistons to restrict vertical to-and-fro movements of the first and second treads, and, at an open position, release the first and second tread controls to enable, upon the first tread control and the second tread control being activated, vertical to-and-fro movements of the first and second treads, wherein the first tread and the second tread are configured to move vertically to-and-fro from the reference plane, respectively, via the first tread control and the second tread control in a step lock control manner, and wherein the step lock manner is such that when the first tread remains locked in an upper-most position, the second tread moves to-and-fro vertically towards the lower-most position and back towards the upper-most position, and wherein when the second tread reaches the upper-most position, the second tread releases the first tread to move vertically to-and-fro towards the lower-most position and back towards the upper-most position, while the second tread remains locked in the upper-most position until the first tread reaches at the upper-most position.

2. The apparatus as in claim 1, wherein the pair of retractable mechanisms comprises a spring, in that, one end of the spring is coupled to the mounting plate while other end is coupled to an end portion of the tread catch to biasingly engage the tread catch at a position.

3. The apparatus as claimed in claim 2, wherein the catch and release mechanism comprises respective stops on both opposite surface to engage with the respective tread release and tread catch to provide support thereto at the position.

4. The apparatus as claimed in claim 1 further comprising:

a hydraulic bypass ports configured in the control valve, when open, facilitate a flow of hydraulic fluid throughout respective hydraulic cylinders of the hydraulic cylinders with internal pistons; and two one-way valves configured in respective pistons of the hydraulic cylinders with internal pistons head to enable movement of the two treads.

5. The apparatus as claimed in claim 1 further comprising a stationary pivot coupled at an end portion of each of the two hydraulic cylinders with internal pistons; and a movable pivot coupled to between opposite ends of each of the two hydraulic cylinders with internal pistons and at respective tread of the two treads.

6. The apparatus as claimed in claim 1 further comprising a catch and release mechanism to enable the climbing movement of the respective first and second treads, wherein the catch and release mechanism comprises a mounting plate having opposite surfaces, a pair of tread catches disposed along the opposite surfaces and along opposite sides of the mounting plate, such that, portions thereof extend outward from opposite sides to engage with the respective first and second treads, a pair of tread releases disposed along the opposite surfaces and along opposite sides of the mounting plate, in engagement with the respective tread catches of the pair of the tread catches, such that, portions thereof extend outward from opposite sides to engage with the respective first and second treads, and a pair of retractable mechanisms, each coupled to the mounting plate along the opposite surfaces and with respective tread catches.

* * * * *